United States Patent [19]

Karlsson et al.

[11] Patent Number: 5,074,366

[45] Date of Patent: Dec. 24, 1991

[54] METHOD AND APPARATUS FOR HORIZONTAL DRILLING

[75] Inventors: Haraldur Karlsson, Kingwood; Gary E. Jacques, Houston, both of Tex.; James L. Hatten, Sumrall, Miss.; John K. Aslakson, Sandy, Utah

[73] Assignee: Baker Hughes Incorporated, Houston, Tex.

[21] Appl. No.: 541,836

[22] Filed: Jun. 21, 1990

[51] Int. Cl.[5] ..... E21B 10/66

[52] U.S. Cl. ..... 175/76; 166/381; 175/259; 175/267

[58] Field of Search ..... 166/242, 381; 175/257, 175/258, 259, 260, 261, 263, 267, 321, 61, 62, 97, 101, 76

[56] References Cited

U.S. PATENT DOCUMENTS

| | | | |
|---|---|---|---|
| 32,267 | 10/1886 | Cherrington | 175/53 |
| 3,878,903 | 4/1975 | Cherrington | 174/45 |
| 3,933,209 | 1/1976 | Sweeney | 175/257 |
| 3,996,758 | 12/1976 | Cherrington | 61/105 |
| 4,003,440 | 1/1977 | Cherrington | 175/61 |
| 4,043,136 | 8/1977 | Cherrington | 61/72.7 |
| 4,176,985 | 12/1979 | Cherrington | 405/184 |
| 4,354,559 | 10/1982 | Johnson | 175/267 |
| 4,453,603 | 6/1984 | Voss et al. | 175/53 |
| 4,545,443 | 10/1985 | Wiredal | 175/258 |
| 4,610,307 | 9/1986 | Jurgens et al. | 175/320 |
| 4,651,837 | 3/1987 | Mayfield | 175/261 |
| 4,679,637 | 7/1987 | Cherrington et al. | 175/61 |
| 4,697,651 | 10/1987 | Dellinger | 175/76 |
| 4,739,842 | 4/1988 | Kruger et al. | 175/61 |
| 4,765,416 | 8/1988 | Bjerking et al. | 175/257 |
| 4,807,708 | 2/1989 | Forrest et al. | 175/45 |
| 4,828,050 | 5/1989 | Hashimoto | 175/45 |
| 4,842,081 | 6/1989 | Parant | 175/23 |

OTHER PUBLICATIONS

"Tigre Tierra Casing Drivers" by Aardvark Corporation (1988).

"Operating Instructions and Spare Parts Lists for Controlled Deviation Drilling Equipment DEVIBOR" by Craelius AB (1987).

"The Steerable System-Job Performance Data-Casing Drill-Offshore Gulf of Mexico" by Smith International (1978).

*Primary Examiner*—Terry L. Melius

*Attorney, Agent, or Firm*—Trask, Britt & Rossa

[57] ABSTRACT

The present invention comprises a method and apparatus for simultaneously drilling and casing a wellbore. More specifically, the apparatus comprises and outer conduit string containing an inner drill string carrying a bit capable of drilling a wellbore of greater diameter than the outer string. The drill string may be adapted to drill a nonlinear wellbore by offsetting the drill bit from the longitudinal axis of the outer string, and the drill bit is preferably retractable to permit withdrawal of the drill string after the wellbore is completed, leaving the outer string of casing or liner in place. The wellbore is drilled by rotating the drill bit and advancing the drill string by pushing from the surface, and the outer string is advanced by being pulled along by the drill string.

19 Claims, 5 Drawing Sheets

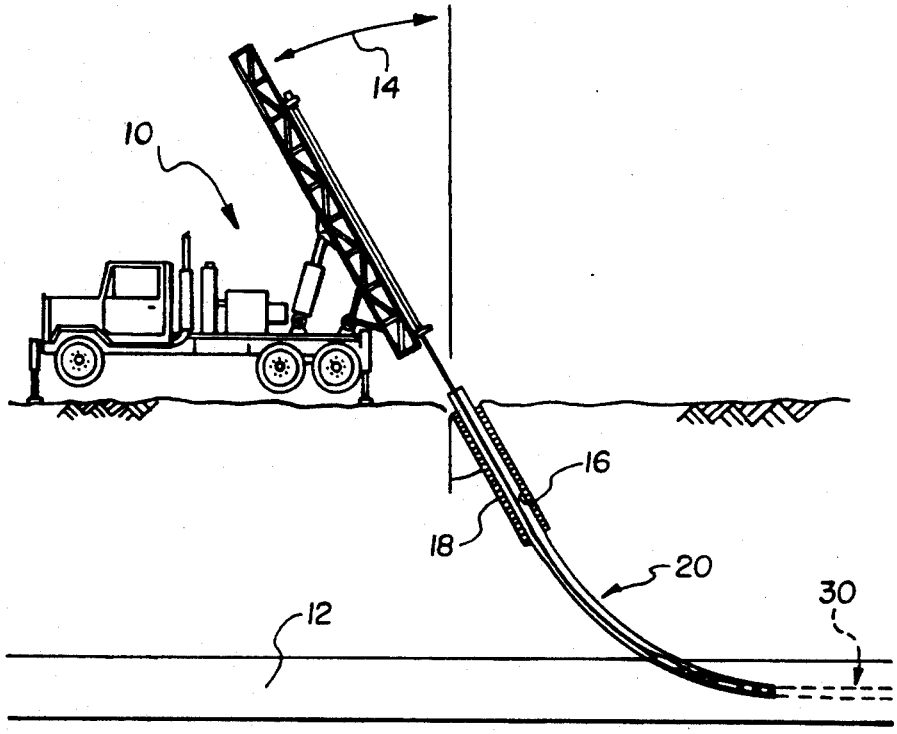
Fig. 1
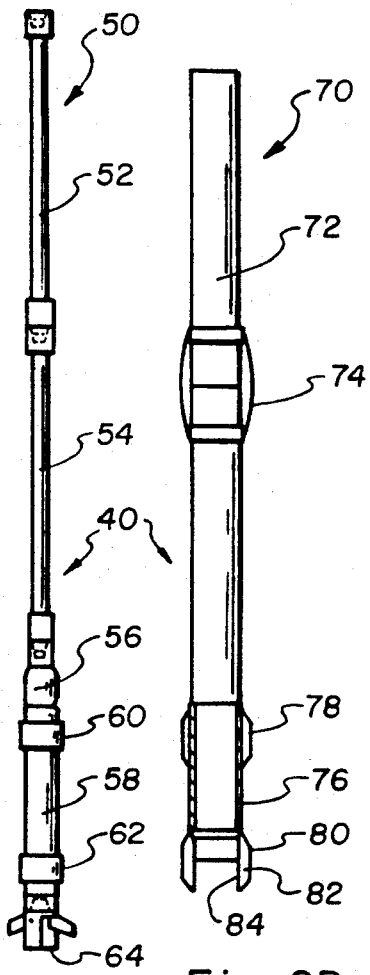
Fig. 2A
Fig. 2B
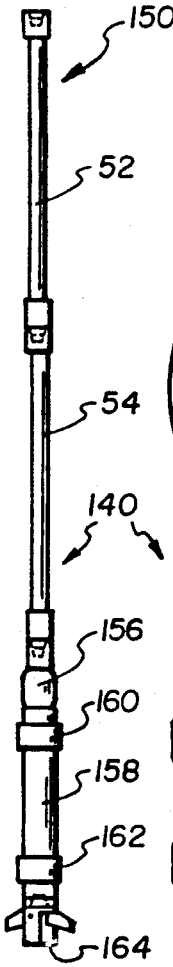
Fig. 3A
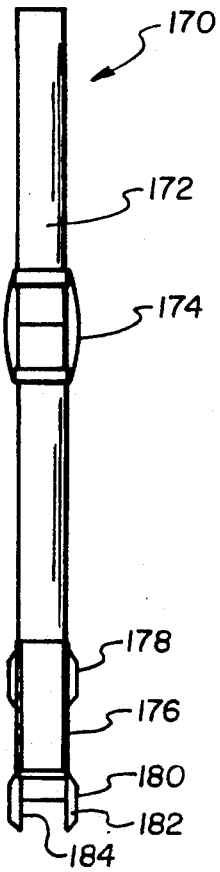
Fig. 3B

METHOD AND APPARATUS FOR HORIZONTAL DRILLING

BACKGROUND OF THE INVENTION

Drilling highly deviated and horizontal wells has been known for decades, and various methods and apparatus have been employed more or less successfully. Emphasis on horizontal drilling has been cyclical and dependent upon the price level of oil, gas and other natural resources which may be recovered via the use of such techniques.

Horizontal drilling apparatus, and particularly apparatus which can be precisely controlled as to depth and azimuth or direction are very useful in recovering natural resources from subterranean formations which are of nominal thickness, as conventional vertical drilling techniques can only intersect such formations for a short interval (i.e., the formation thickness) so that the total surface area of the wellbore exposed to the formation and from which the natural resources may be recovered is extremely limited. On the other hand, a horizontal drilling apparatus, and particularly a steerable apparatus, can not only intersect the target formation but follow its path under the earth for hundreds or even thousands of feet, exposing the wellbore to a formation surface area many orders of magnitude greater than that achievable by conventional vertical drilling techniques. The falling and stabilization of oil prices in recent years at levels less than half of those encountered in the early 1980's has generated renewed interest in horizontal drilling as a means to maximize production from each well drilled, and therefore the operator's profit margin.

In addition to natural resource recovery applications of horizontal drilling, enactment of environmental legislation during the past two decades and enhanced monitoring and enforcement activities by federal and state governments has opened vast new fields of opportunity for a compact, easily transportable, economical horizontal drilling method and apparatus which can be employed to drill monitoring, injection, recovery and barrier wells in the vicinity of land fills, industrial sites, toxic waste repositories and other locations in which the natural environment has or may become contaminated through man's intentional actions or neglect. Subsurface monitoring and remediation techniques for contaminated sites are in their infancy, but in most instances require the ability to not only surround but also to reach under the suspected or confirmed contaminated plume or volume of earth from a remote position outside of the zone of contamination. Moreover, the vast size of many sites requires the drilling and completion of hundreds if not thousand of wells at a single location.

Existing methods and apparatus for horizontal drilling have been developed for oil recovery, mineral recovery and for the installation of cables and pipes under rivers, swamps, highways, building and other natural and man-made obstacles. While potentially applicable to environmental remediation activities, they are generally expensive to build and to use, and in many instances lack the ability to follow a relatively precise path. This latter point is extremely important when drilling at very shallow depths, as inadvertently drilling from below into a plume of contaminated earth may result in catastrophic groundwater contamination where none previously existed. Drilling systems which can complete a well as it is being drilled are extremely desirable, from a rig time cost saving standpoint and, more important, because subsurface formations at shallow depths are generally unconsolidated and therefore lack inherent physical strength against collapse of the wellbore once the drill string is withdrawn. Such collapse requires redrilling of the well and also may enhance flow of contaminants from a contaminated but previously isolated zone above the wellbore, thus aggravating the existing problem.

In short, there has been a long felt and ever increasing need for a compact, economical, easily transportable horizontal drilling system which can be effectively used at environmental monitoring and remediation sites.

SUMMARY OF THE INVENTION

The method and apparatus of the present invention addresses the drilling needs of the environmental industry in a manner vastly superior to the prior art, and is also adaptable to other applications.

More specifically, the apparatus of the present invention comprises a steerable downhole drilling apparatus, also known as a bottom hole assembly, including an inner string of drill pipe terminating at its lower end in a fluid driven, preferably Moineau type motor driving an expandable drill bit. The inner string is removably disposed within an outer, larger diameter string which is preferably centralized and which, including centralizers, is of lesser diameter than the expanded diameter of the drill bit. The end of the outer string, which is preferably stabilized, includes a casing shoe having an inner shoulder or ledge thereon, which is of such diameter so as to engage an inner string stabilizer disposed at the end of the motor adjacent the drill bit, thus arresting the motor's passage through the open end of the outer string. The drill bit, when expanded, drills a wellbore of sufficient diameter to accommodate both the inner and outer strings and, when the desired reach of the wellbore has been achieved, the inner string is retracted through the outer string and the well is completed as desired.

The apparatus of the present invention also provides a steering capability, including a curve drilling capability, via the use of first and second stabilizers of selective and preferably adjustable eccentricity mounted on the downhole motor. When a curved drilling path is desired, such as when the wellbore commenced from the surface is to be turned to the horizontal, the motor stabilizers are adjusted to an extreme eccentric position, resulting in a tilting of the downhole motor with respect to the outer string, and resultant offset of the drill bit, causing it to drill a curved path. When the wellbore reaches the horizontal, which is predictable from the system characteristics but also verifiable by survey devices know in the art, the inner string is withdrawn and the motor stabilizers adjusted so as to cause the motor to be substantially concentrically oriented within the outer string, causing the drill bit to drill a straight well bore. In the event that, due to unforeseen formation characteristics or subsurface obstacles, it is desirable to redirect the wellbore, the inner string can be pulled again and a suitable degree of stabilizer eccentricity selected, whereupon the inner string is rerun to the end of the outer string, the bit expanded and a curved path drilled to the desired heading. Alternatively, a slight amount of eccentricity is maintained in the stabilizers, which results in a very slight bit tilt relative to the outer casing or liner. By partial rotation of the inner string through an arc with respect to the outer string, the bit offset may be directed up or down, left or right with respect to the existing instantaneous path of the wellbore, and continual course corrections made. This latter methodology is most suitably used when a steering tool is placed downhole immediately behind the motor, and real time wellbore path data obtained via a wireline or other means known in the art, including mud, acoustic or magnetic pulses, or radiotelemetry.

The method of the present invention comprises simultaneously drilling a wellbore and running a casing or liner while drilling. The method of the present invention also comprises simultaneously drilling a wellbore using a single drill bit and running a casing or liner while drilling, and additionally withdrawing the drill bit from the wellbore, leaving the casing or liner in place.

More specifically, the method of the present invention comprises providing an inner drill string including an expandable bit driven by a fluid motor having, providing an outer casing or liner string having a shoe at the bottom thereof to permit passage of the bit in an unexpanded mode therethrough while preventing passage of the motor, running the inner drill string into the outer string, expanding the bit to a diameter larger than that of the casing or liner string, and simultaneously drilling and casing a wellbore. The method further comprises the step of applying a longitudinal force to the drill bit through the drill string to cause it to engage the formation being drilled, and to cause the inner drill string to pull the outer string into the wellbore as it is being drilled. The method still further comprises the step of steering the bit to cause it to vary its path by providing means to offset the bit at an angle to the outer casing or liner string and selectively rotating the drill string through an arc of less then 360 degrees so as to reorient the bit tilt, and drilling at the new orientation. Moreover, the method comprises adjusting the bit offset to a plurality of angles to alter the radius of curvature of the wellbore being drilled. Finally, and by way of example and not limitation, the method comprises sensing the path of the wellbore as it is being drilled and reorienting the bit offset to correct for deviations of the wellbore from its intended path. Such sensing may be substantially continuous, and said reorientations of the bit tilt may be effected without pulling the inner drill string from the wellbore.

The method of the present invention, in one specific embodiment, also contemplates using one bottom hole assembly to drill the curved sector of the wellbore to the desired total vertical depth (TVD), cementing the outer string of casing in place, and drilling the horizontal sector of the wellbore with a smaller bottom hole assembly utilizing a slotted liner outer string, and withdrawing the inner drill string, leaving the liner string in place for well completion.

BRIEF DESCRIPTION OF THE DRAWINGS

The method and apparatus of the present invention will be more readily understood and fully appreciated by those of ordinary skill in the art through a review of the detailed description of the preferred embodiments, taken in conjunction with the accompanying drawings, wherein:

FIG. 1 comprises a schematic of a slant drill rig drilling a horizontal wellbore according to the present invention;

FIGS. 2A and 2B comprise, respectively, schematics of an inner drill string and an outer casing string which together comprise a bottom hole assembly according to the present invention suitable for drilling a curved wellbore;

FIGS. 3A and 3B comprise, respectively, schematics of an inner drill string and an outer liner string which together comprise a bottom hole assembly according to the present invention suitable for drilling a horizontal wellbore;

DETAILED DESCRIPTION OF THE PREFERRED EMBODIMENTS

Figure 4A:
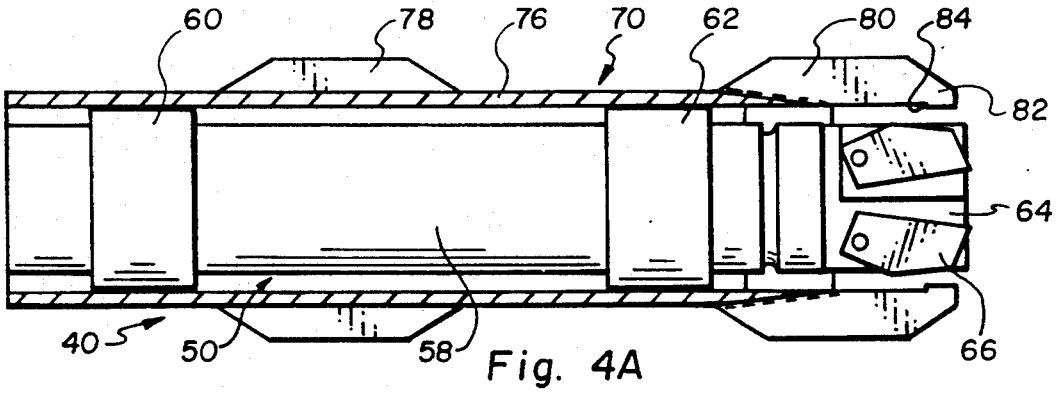
FIGS. 4A, 4B and 4C comprise enlarged schematics of the lower end of the inner drill string of the present invention disposed within the outer string in tripping, curved drilling and horizontal drilling modes.

Referring now to FIG. 1 of the drawings, a slant type drill rig 10 as is known in the art is depicted in the operation of drilling into the horizontally-oriented target zone or subterranean formation 12. As indicated by arrow 14, slant rig 10 is preferably capable of varying the tilt of the drilling mast from vertical to a predetermined angle, preferably seventy degrees, from vertical in order to permit reaching a horizontal wellbore orientation at various TVD's depending upon the job requirements. Slant rig 10 also includes a drive to rotate and to apply longitudinal force to bottom hole assemblies 40 and 140, the reason for which will hereinafter become apparent.

Before drilling of a well or a series of wells begins, each is carefully engineered to meet the objectives of the operation, be they monitoring, remediation or otherwise. The depth and direction of the horizontal portion of the wellbore, liner screen length and number of centralizers as well as completion, development and pumping methods are predetermined due to the contaminated or purportedly contaminated nature of the monitoring or remediation site.

After the above planning operation is completed, rig 10 is moved into place and aligned to drill the lateral or horizontal portion of the wellbore in the desired direction, the angle of the mast being adjusted to provide the desired TVD of the wellbore after a curved wellbore section of a given radius is drilled. Thereafter, a hole is augured into the earth from the surface using the power top drive of the drill rig, and a conductor pipe or casing 16 is set and cemented in place as shown at 18. The foregoing steps are well known in the art, and do not form a part of the present invention.

Referring now to FIGS. 2A and 2B of the drawings, the bottom hole assembly 40 for drilling the curved sector 20 (see FIG. 1) of the wellbore is shown to comprise inner drill string 50 and outer casing string 70.

Inner string 50 includes, from the top down, at least one stand of drill pipe 52, preferably in twenty foot lengths and of $2\frac{7}{8}''$ diameter, formed of grade "G" low alloy steel. Each stand of drill pipe 52 includes pin and box threads at the ends thereof for connection to other stands above and below as drilling proceeds. Below the lowermost stand of drill pipe 52 is a $2\frac{7}{8}''$ non-magnetic survey collar 54 with an orienting muleshoe (not shown) at the bottom interior thereof as is known in the art for receiving and orienting a survey or steering tool. Collar 54 also is provided with pin and box type threads for connection to the drill pipe 52 above and ball joint 56 of motor 58 below. Motor 58 is preferably a $6\frac{3}{4}''$ diameter low speed high torque Moineau type hydraulic motor operable using fresh water as a drilling fluid, as no additives which may cause formation contamination are permitted in drilling at a monitoring or remediation site. Ball joint 56 is of a design, known in the art, wherein mutual rotation of collar 54 and motor 58 about the longitudinal axis of the bottom hole assembly 40 is prevented, while the included angle between the longitudinal axes of collar 54 and motor 58 is permitted to vary in order to isolate motor 58 from bending stresses, and particularly those attributable to the passage of the bottom hole assembly 40 through a short radius curve sector of the wellbore. Mounted on the exterior of the motor near the upper and lower ends thereof are stabilizers 60 and 62, which may each comprise mutually rotatable interior and exterior components which in a first mutual rotational orientation result in the exterior component substantially concentrically surrounding motor 58, and in a second rotational orientation result in the exterior component eccentrically surrounding motor 58, differing degrees of mutual rotational component orientation between the two extremes resulting in differing degrees of stabilizer eccentricity. Alternatively, stabilizers 60 and 62 may comprise slip-on or screw-on collar type stabilizers which may be interchanged depending upon the degree of eccentricity or concentricity desired. At the lower end of inner drill string 50, expandable bit 64 (shown in its expanded mode at $12\frac{1}{4}''$ diameter) is secured to the driveshaft of motor 58. Expandable bit 64 may be of one of several designs known in the prior art, but an especially suitable design for both bit 64 and bit 164 is depicted in FIG. 8 of the drawings, and will be described in some detail hereafter. However, several suitable bit designs, including that of FIG. 8, are disclosed and claimed in copending U.S. patent application Ser. No. 541,841, filed on even date herewith and incorporated herein for all purposes by this reference.

Outer string 70 is comprised, beginning at the top, of one or more stands of nominal ten inch casing 72, preferably of high density polyethylene (HDPE), as this material is light, inexpensive, flexible and inert with respect to other substances, such as contaminants. Spring type centralizers 74, such as are known in the art, are placed at suitable intervals to centralize casing 72 within the wellbore prior to cementing. The number of centralizers 72 is dependent upon the length of the curve to be drilled and spring strength, the centralizer springs normally being of greater diameter than the hole diameter (in this instance $12\frac{1}{4}''$) so as to be compressed to centralize the casing when run into the hole and permit cement to fully encompass it thereafter. Casing stands 72 have threaded connectors at each end thereof for securing stands to each other and to casing joint 76 at the lowermost or leading end of outer string 70. Casing joint 76 is preferably formed of HDPE, approximately nine inches in I.D. and $10\frac{3}{4}''$ in O.D., and of a length approximating that of motor 58, not including ball joint 56. Upper and lower concentric stabilizers 78 and 80, respectively, are mounted on casing joint 76, and provide it with a $12\frac{1}{8}''$ gage. Stabilizers 78 and 80 may be of steel or any other suitable material. At the bottom of casing joint 76, casing shoe 82, which preferably is integral with lower stabilizer 80, includes an inwardly extending shoulder 84 at its lower end to provide a seat for lower motor stabilizer 62, the purpose of which will be explained shortly.

Referring to FIGS. 3A and 3B of the drawings, a bottom hole assembly 140 for drilling the horizontal sector 30 of the wellbore according to the present invention is shown to comprise inner drill string 150 and outer liner string 170.

Inner string 150 includes, from the top down, drill pipe 52 and non-magnetic collar 54 as previously described with respect to inner string 50. Motor 15, secured to collar 54 by ball joint 156 of the same type as ball joint 56, is preferably of the same type but smaller diameter and lower power than motor 58, and preferably $4\frac{3}{4}''$. Stabilizers 160 and 162 are of the same design as stabilizers 60 and 62, that is to say adjustable or replaceable as between concentric and eccentric orientations with respect to the motor axis. Expandable bit 164 is secured to the drive shaft of motor 158 and is shown in its $8\frac{5}{8}''$ diameter expanded mode in the drawing.

Outer liner string 170 includes, from the top down, one or more stands 172 of six inch nominal HDPE slotted liner, surrounded at appropriate intervals by centralizers 174 to provide centralization during a subsequent completion (gravel packing) operation. At the bottom of lowermost liner stand 172 at the leading end of liner string 170 is casing joint 176 having upper and lower concentric stabilizers 178 and 180 thereon, providing an $8\frac{1}{2}''$ gage. The I.D. of the joint is approximately 5.65" and the O.D., 6.6". Casing shoe 182, which is preferably integral with lower stabilizer 180, includes inwardly extending shoulder 184 at the bottom thereof to provide a seat for lower motor stabilizer 162.

Figure 4B:
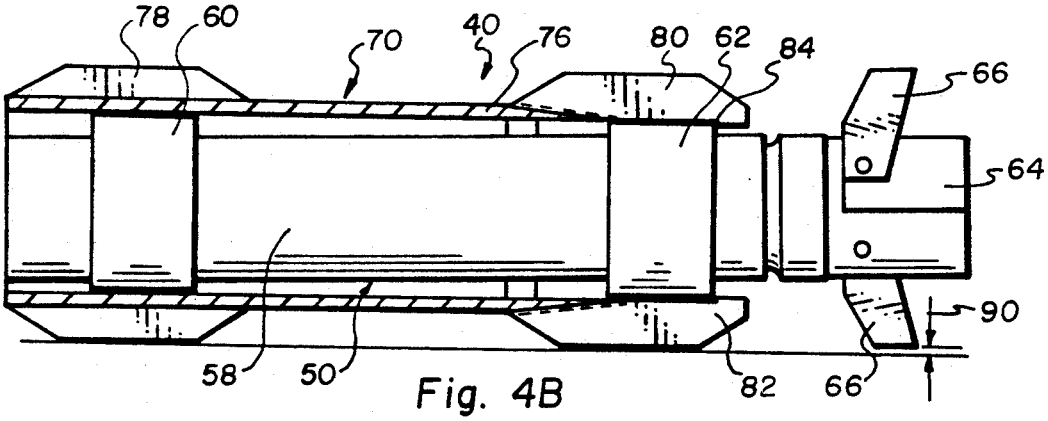
Figure 4C:
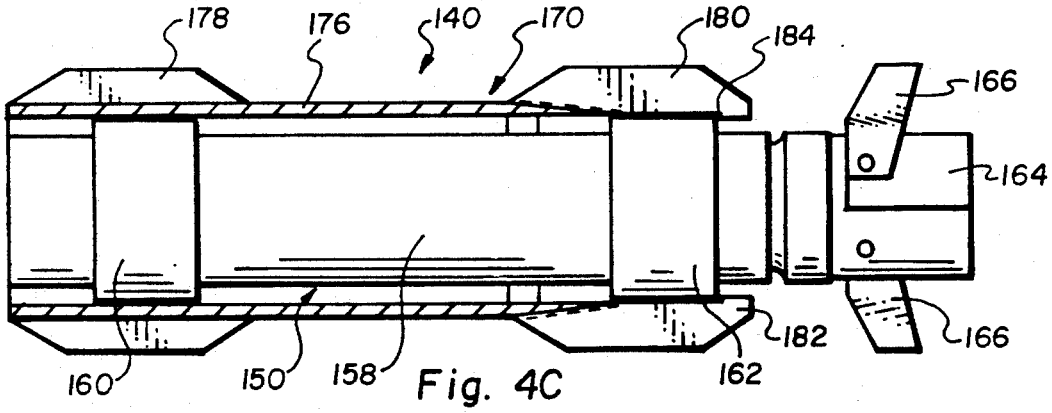

Referring now to FIGS. 4A through 4C, the interrelationship between the inner drill string and outer casing or liner string of the present invention in forming bottom hole assembly 40 and 140 is depicted. FIG. 4A shows the lowermost end of inner drill string 50 as it is being either inserted within outer casing string 70 or withdrawn therefrom. As can be seen, the retracted blades 66 of bit 64 permit passage of the inner string 50 within outer string 70, as stabilizers 60 and 62 are of slightly lesser diameter than the I.D. of casing 72 and casing joint 76. Downward passage of inner string 50 is halted or arrested, however, when lower motor stabilizer 62 contacts shoulder 84 of casing shoe 82, as shown in FIGS. 4B and 4C. Thus, when inner string 50 reaches the end of its travel at the end of outer string 70, and motor 58 is supplied with hydraulic fluid through drill pipe 52 and non-magnetic collar 54, bit 64 begins to turn, bit rotation and fluid flow therethrough causing blades 66 to expand and drill to a diameter greater than that of outer string 70. As a forwardly longitudinally directed force is applied to bit 64 from the surface via drill pipe 52, outer string 70 is pulled forward by inner string 50 because of the interaction of shoulder 84 and lower motor stabilizer 62. The foregoing description of the bottom hole assembly 40 is equally applicable to the components 150 and 170 of bottom hole assembly 140, so the latter will not be described as a unit in detail.

FIG. 4B depicts bottom hole assembly 40 in a curved drilling mode, as can be seen from the bit offset 90 from the path of the wellbore as determined by upper and lower casing joint stabilizers 78 and 80. This offset is caused by the tilting of the motor 58 with respect to casing joint 76 due to the eccentricity of motor stabilizers 60 and 62. Thus, bottom hole assembly will drill a curved well bore in the direction of bit offset, which is known and controlled at the surface, being changeable by rotation of the drill string 50 via drill pipe 52 through a partial arc to a new orientation, ball joint 56 ensuring exact rotation orientation of motor 58. While the foregoing comments have been directed to bottom hole assembly 40, they are equally applicable to bottom hole assembly 140.

FIG. 4C depicts bottom hole assembly 140 in a horizontal drilling mode, wherein stabilizers 160 and 162 are concentric with motor 158 or, at most, very slightly eccentric, so as to cause an almost indistinguishable amount of bit offset. If stabilizers 160 and 162 are truly concentric, the wellbore will be perfectly straight unless diverted by a change in subsurface formation characteristics or an obstacle. If stabilizers 160 and 162 are slightly eccentric, the bottom hole assembly 140 will drill a curve of extremely long radius, and the assembly can be steered, as assembly 40, by rotation of drill string 150 via drill pipe 52 through a partial arc to a new orientation. While the foregoing comments have been directed to bottom hole assembly 140, they are equally applicable to bottom hole assembly 40.

Referring now to FIGS. 5*a* through 5E of the drawings, a drilling operation utilizing the apparatus of the present invention and according to the method of the present invention will be described.

Figure 5A:
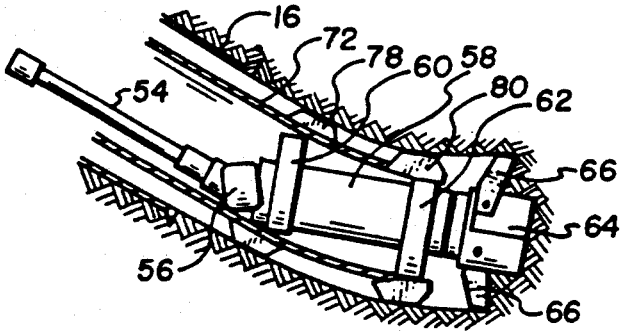
FIGS. 5A, 5B, 5C, 5D and 5E comprise sequential schematics of the apparatus of the present invention drilling the curved and horizontal portions of a wellbore according to the method of the present invention.
Figure 5B:
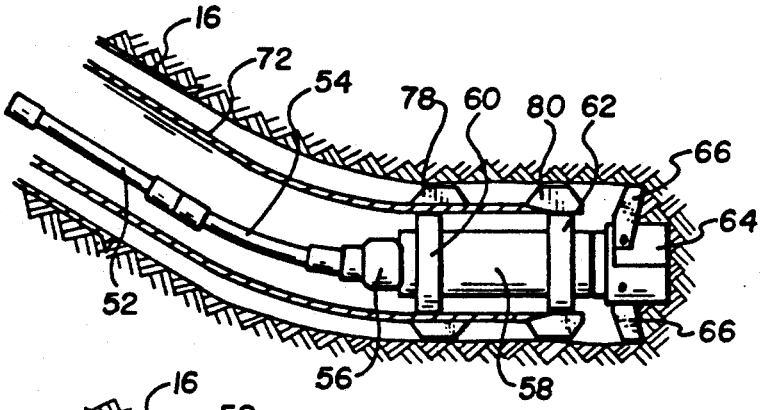

FIG. 5A depicts bottom hole assembly 40 as it drills a curved wellbore sector 20 from the end of surface casing or conductor pipe 16. It will be understood by those skilled in the art that, as the wellbore increases in length, additional sections of casing 72 and stands of drill pipe 52 are added to bottom hole assembly 40 at rig 10 on the surface. Bottom hole assembly 40 is advanced in the wellbore as drilling proceeds by pushing, or applying a forwardly longitudinally directed force to inner drill string 50, which then pulls casing string 70 with it. In this view, the eccentricity of motor stabilizers 60 and 62 has been exaggerated for clarity. When the wellbore reaches a horizontal orientation, inner drill string 50 is withdrawn from the wellbore and motor stabilizers 60 and 62 are either adjusted to a concentric orientation or, if replaceable types are used, concentric stabilizers slipped onto the motor, and drill string 50 reinserted into casing string 70. Next, as shown in FIG. 5B, bottom hole assembly 40 drills ahead horizontally a short distance, for example ten feet, to reduce the bending loads on casing shoe 82 and stabilizers 78 and $0 imposed by casing 72 being pulled into a curved orientation. Drill string 40 is again withdrawn, and casing string 70 is cemented into the wellbore by means known in the art, and preferably by an innerstring type cementing system whereby a cementing plug or shoe is run to casing shoe 82 and cement pumped down an inner string of small diameter tubing or drill pipe within casing string 70 to the end thereof through the plug and out into the annulus between the wellbore wall and the casing string, centralizers 74 providing a standoff for the cement 100 (see FIGS. 5C, D & E) to surround the string and encase it.

Figure 5C:
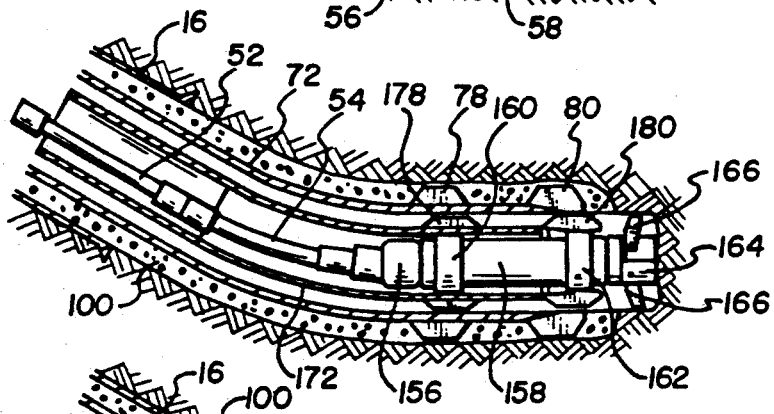

At this point, the innerstring cementing string is pulled from the well, and bottom hole assembly 40 is run within casing string 70 to casing shoe 82. As shown in FIG. 5C, motor 158 is started, and bit 164 expands and drills through the cement at the end of casing string 70 and casing shoe 82, stabilizers 178 and 180 on the exterior of liner string 170 preventing sidetracking of bit 164 as it drills through the shoe and into the formation.

Figure 5D:
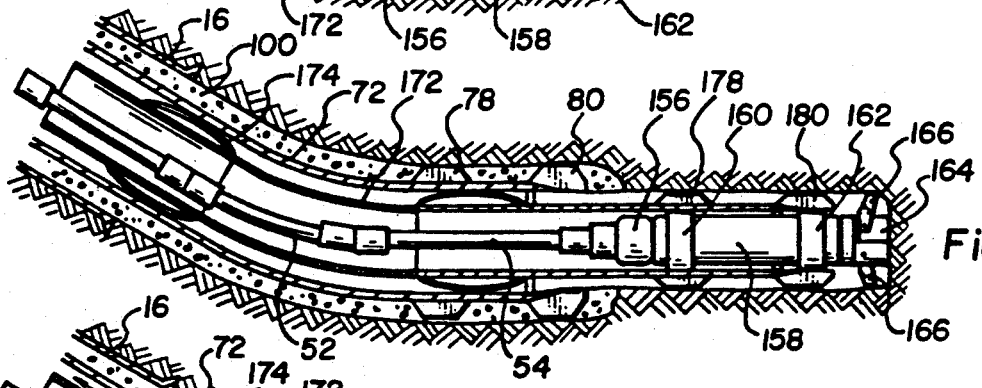
Figure 5E:
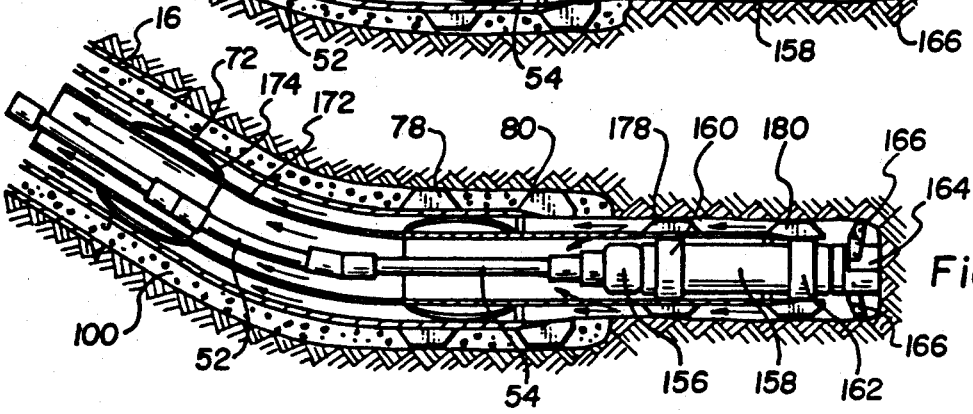

As bottom hole assembly 140 advances into the formation, inner drill string 150 pulls liner string 170 with it, as shown in FIG. 5D, centralizers 174 maintaining liner 172 in the center of the well bore. In the same manner as with bottom hole assembly 40, additional sections of liner 172 and drill pipe 52 are added at rig 10 as the length of the wellbore increases. As can be seen in FIG. 5E, drilling fluid (water) is pumped to motor 158 through drill pipe 52 and then leaves the inner drill string through bit nozzles as is common in the art, after which it returns to the surface primarily through the annulus 180 between the liner string 170 and the wellbore wall until it reaches the cemented in place casing sting 70 where it travels between the I.D. of the casing string and the O.D. of the liner string. Part of the fluid returning to the surface does so through the interior 190 of the liner string 170, due to the fact that the liner is slotted for purposes of subsequent gravel packing. However, all of the drilling fluid returns are taken to the surface, regardless of the path taken, to a tank or other receptacle where cuttings are removed, the fluid filtered, and reintroduced into the drill pipe as is known in the art. The drilling fluid circulation system, unlike many systems used in oil and gas drilling, is completely closed loop, so that no fluid is permitted to contaminate the surface of the job site.

After the desired length of the horizontal sector 30 of the wellbore is reached, inner drill string 150 is withdrawn from the well, while liner string 170 remains in place, centralized in annulus 180 by centralizers 174. It is then normally desirable to gravel pack the wellbore around the liner string 170 in order to prevent formation collapse, and clogging of the liner slots. A preferred procedure for gravel packing a horizontal wellbore is described and claimed in copending U.S. patent application Ser. No. 07/541,839 filed on even date herewith and incorporated for all purposes herein by this reference.

It will be understood and appreciated by those of ordinary skill in the art that the terms "casing string" and "liner string" as used herein both describe a tubular conduit within which a drill string may be run according to the present invention, and the terms "liner string" has been used for convenience to address a conduit, slotted or unslotted, of lesser diameter than another conduit, termed a "casing string". In fact, only a single conduit may be run in practicing the invention, and the use of two such conduits, the smaller thereof being apertured or slotted, is disclosed as exemplary of the preferred embodiment of the invention, and not as a limitation thereof.

Figure 6:
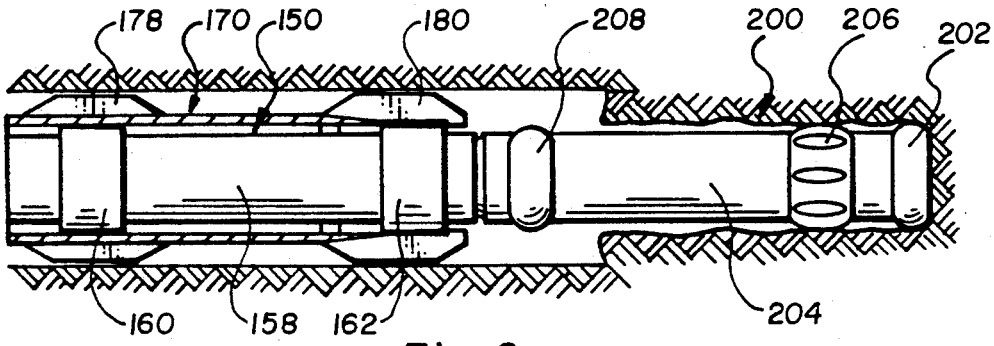
FIG. 6 comprises a schematic of a motor coring apparatus which may be employed as part of the present invention.

FIG. 6 of the drawings depicts a caring assembly 200 which can be run into the wellbore on inner drill string 150 and driven by motor 158 in lieu of a drill bit. Coring assembly 200 includes a core bit 202 at the lower and of core barrel 204, which surrounds an inner tube (not shown) for receiving the core as is known in the art, the inner tube being supported on bearing means within the core barrel to maintain alignment with and rotational relationship with respect to core barrel 204 and core bit 202. Of course, if core orientation is unimportant, the inner tube could rotate with the core barrel. Unique to the coring assembly 200 is stabilizer 206 to ensure a straight coring path, and a flexible coupling 208 in the drive train between motor 158 and core barrel 204 to permit coring assembly 200 to pass through the short radius curved sector 20 of the well between the conductor pipe or casing 16 at the surface and the horizontal sector 30 of the wellbore. After a core is taken, coring assembly 200 is withdrawn from the well, and inner drill string 150 with a bit replaced on the drive shaft of motor 158 is again run into the wellbore for drilling ahead. Multiple core samples may be taken sequentially by rerunning coring assembly into the wellbore, and it is contemplated that at some sites it may be desirable to core completely through the plume of contaminants to measure relative concentrations and direction of travel of the contaminants.

Figure 7:
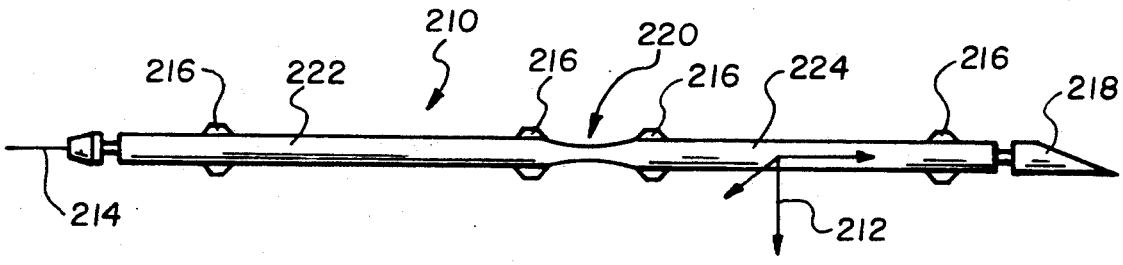
FIG. 7 comprises a schematic of a survey tool which may be used to survey the wellbore drilled by the present invention or to steer the well bore as it is being drilled.

FIG. 7 of the drawings schematically depicts an articulated survey tool 210 which can be employed inside drill strings 50 and 150 to measure dogleg of the wellbore and its orientation. From these measurements and a known reference section of the well, the azimuth and inclination of the wellbore (as well as the location of the bottom hole assembly at any given time) may be calculated using methods well known in the surveying art. The tool can be a single shot or multi-shot tool, of conventional or electromagnetic design. A tri-axial accelerometer is included arrows 212 for the ability to ascertain the high side of the drill string for steering purposes. The survey information can be stored in the tool on magnetic media for survey purposes, or transmitted to the surface real-time via wireline 214 for steering. Concentric stabilizers 216 surround the instrument housing of the tool to centralize it in the drill string, while orienting nose 218 at the lower end of the tool engages an orienting mule shoe at the bottom of nonmagnetic survey collar 54 at the end of the drill string. Strain gauges may be placed in section 220 of the tool to measure the relative bend between upper and lower tool housings 222 and 224. One suitable articulated downhole tool capable of use with the present invention is disclosed and claimed in U.S. Pat. No. 4,901,804, issued Feb. 20, 1990 and assigned to the assignee of the present invention.

Figure 8A:
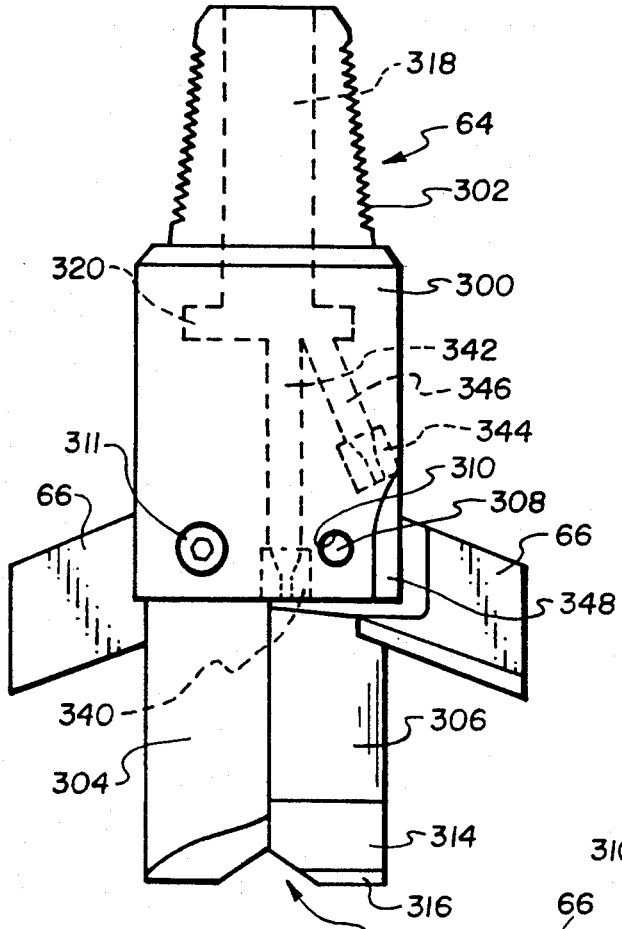
FIGS. 8A, 8B and 8C comprise, respectively, a side elevation, a side sectional elevation and a bottom elevation of an expandable drill bit particularly suited for use with the present invention.
Figure 8B:
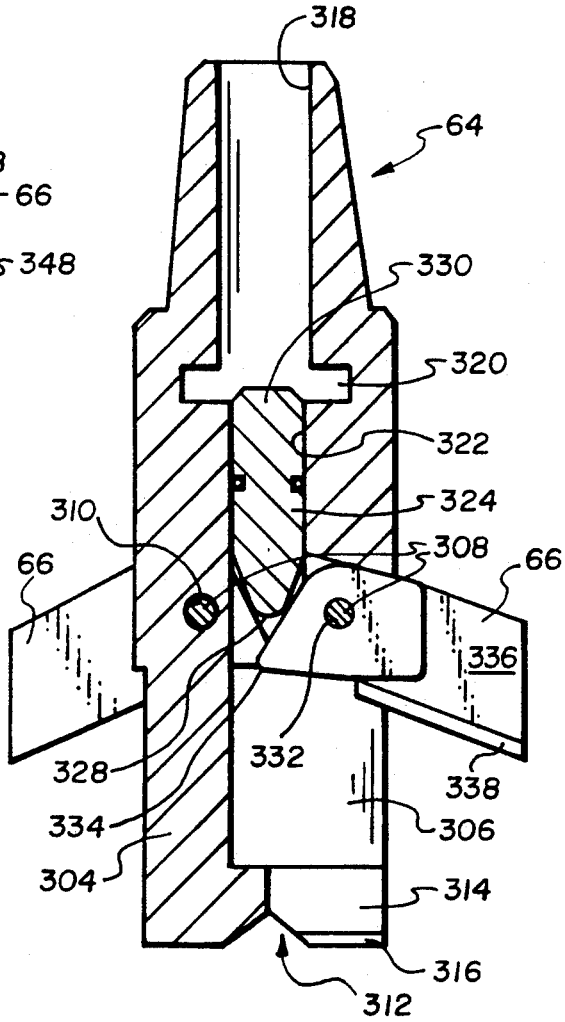
Figure 8C:
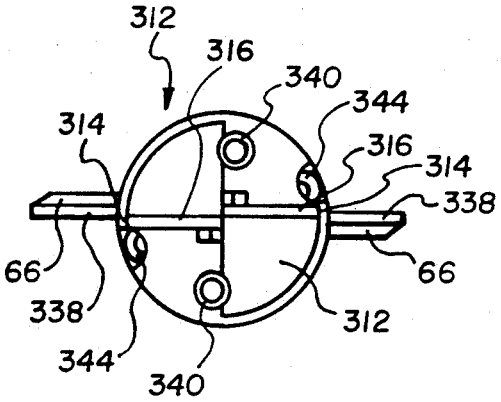

FIGS. 8A–C disclose a drill bit 64 having two blades 66 pivotally mounted on bit body 300 having a threaded pin portion 302 at the top thereof, by which bit 64 may be secured to the driveshaft of downhole motor 58. It should be understood that bit 164, as previously referred to herein, may be identical to bit 64, except of smaller diameter for use with motor 158.

The lower portion of bit 64 comprises a blade housing 304 defining blade cavities 306 in which blades 66 are pivotally disposed on pivot pins 308, set in bores 310 which are perpendicularly oriented to the axis of bit 64, and laterally offset therefrom. Pins 308 are secured in blade housing 304 by any conventional means such as threaded pin head 310, the top of which is shown in FIG. 8A.

The bottom of bit 64 comprises pilot bit 312, including pilot blades 314 having hardfacing, such as a tungsten alloy, on at least the edges 316 thereof, edges 316 having a slight backrake with respect to the plane of the blades 66.

Referring to FIG. 8B, axial fluid entry counterbore 318 extends from the top of bit 64 to toroidal fluid plenum 320 surrounding the upper end of plunger bore 322 in which blade expansion plunger 324 is disposed, O-ring 326 providing a sliding fluid seal between the exterior of plunger 324 and the wall of plunger bore 322. The lower end of plunger 324 terminates at hemispherical blade contact 328. Upper end 330 of plunger 324 extends into counterbore 318 when bit blades 66 are in their retracted position, thus defining a restricted hydraulic flow area between plunger 324 and the wall of counterbore 318 for enhanced responsiveness to increases in fluid flow.

Bit blades 66 are generally planar in configuration, and may be described as winglike. Blades 64 have pivot pin apertures 332 therethrough, through which pivot pins 308 extend. The uppermost ends of blades 66 comprise small radiused plunger contacts 334 which are acted upon by blade contact 328. Preferably, the entire leading face 336 of each blade 66 is hardfaced, but at least the edge 338 is hardfaced. As with the pilot blades, edges 338 of blades 64 are preferably backraked. A spring-loaded ball detent (not shown) may be placed in the wall of the blade housing 304 in each blade cavity 306 adjacent each blade 64 to interact with a dimple on the side of each blade to maintain blades 64 in the retracted position against gravity as the bit is run or withdrawn horizontally. Alternatively, a torsional spring may be placed on the pivot pins to act on the blades, magnets may be used, or other means known in the art may be employed.

FIGS. 8A and 8C illustrate the drilling fluid paths utilized in bit 64. Toroidal plenum 320 feeds two pilot bit nozzles 340 via passages 342, and two bit nozzles 344 via passages 346. Nozzles 340 may be oriented parallel to the bit axis, or slightly inclined toward their respective pilot blades. Nozzles 344 are angled outwardly from the bit axis in order to provide a cleaning flow for blades 66 in their expanded position. Nozzles recesses 348 in the exterior of the bit permit nozzles 344 to be placed within the radial dimensions of the bit body while allowing a clear flow path toward the leading faces of the blades 66.

In operation, bit 64 would normally be run into the wellbore in its retracted position on drill string 50 within outer string 70. When it is desired to expand the bit to drill ahead, as shown in FIG. 5A, it is necessary to expand bit 64 to drill a bore larger than that of outer string 70, so fluid flow is commenced or increased to a sufficient volume to actuate plunger 324 to pivot blades 66 about pins 308 to extend from blade cavities 306 to increase the effective cutting diameter of the bit. As blades 66 contact the formation, the contact will further serve to expand the blades outwardly. As the bit rotates after full expansion of blades 66, the pilot blades 314 will cut the center of the bore being drilled, while blades 66 will cut the outer extent thereof surrounding pilot blades 314. The pilot bit nozzles and bit nozzles direct hydraulic flow to cool and clean the blades and to remove formation cuttings from the vicinity of the blades and up the wellbore annulus. If it is desired to withdraw bit 64 from the wellbore, fluid flow is reduced and the blades retract into cavities 304 when the tops thereof contact casing shoe 82 as drill string 50 is withdrawn into outer string 70, bit 64 then being pulled from the wellbore on drill string 50. The bit may then be replaced with a new bit, or reinserted in the well, and expanded as previously described.

While the foregoing description of the structure and operation of an expandable bit has been directed to bit 64, it should be understood that it is equally applicable to bit 164. Other, equally suitable bits for use with the present invention are described and claimed in the aforementioned and previously incorporated U.S. patent application Ser. No. 541,841.

While the apparatus and method of the present invention have been described with reference to certain preferred embodiments, it will be understood and appreciated by one of ordinary skill in the art that many additions, deletions and modifications to the preferred embodiments may be made without departing from the scope of the intention as hereinafter claimed.

We claim:

1. An apparatus for drilling and lining a wellbore, comprising:

a tubular outer string having a longitudinal axis and a leading end;

an inner string disposable within said outer string and including:

drill pipe means having a longitudinal axis;

motor means having a longitudinal axis and disposed on said drill pipe means;

a drill bit for defining a bore of greater diameter than said outer string, driven by said motor means and disposable outside said outer string proximate said leading end; and first and second longitudinally spaced stabilizers of lesser diameter than the interior of said outer string and associated with said motor means for the orientation of the longitudinal axis thereof with respect to the longitudinal axis of said outer string at the leading end thereof; and means for arresting the passage of said inner string through said outer string.

2. The apparatus of claim 1, wherein at least one of said stabilizers is eccentric with respect to said inner string.

3. The apparatus of claim 1, wherein at least one of said stabilizers is of selectively variable eccentricity with respect to said inner string.

4. The apparatus of claim 3, wherein said at least one selectively variable stabilizer is rotationally variable.

5. The apparatus of claim 3, wherein said at least one selectively variable stabilizer is replaceably variable.

6. The apparatus of claim 1, wherein said outer string includes a plurality of centralizer means disposed about said casing means at longitudinally spaced intervals.

7. The apparatus of claim 6, wherein said casing means includes at least one section having apertures through the wall thereof.

8. The apparatus of claim 1, wherein said drill bit is retractable to a diameter less than that defined by said casing shoe means.

9. The apparatus of claim 1, wherein said drill bit is expandable from a diameter less than that defined by said casing shoe to said diameter greater than that of said outer string.

10. The apparatus of claim 1, wherein said drive means comprises fluid driven motor means proximate said drill bit and adapted to receive said driving fluid through said drill pipe means.

11. The apparatus of claim 10, wherein said drive fluid comprises water.

12. The apparatus of claim 10, further including a ball joint interposed between said drill pipe means and said motor means and adapted to prevent mutual rotation therebetween while permitting variation of an included angle defined between the longitudinal axes thereof.

13. The apparatus of claim 10, wherein said first and second longitudinally spaced stabilizers are mounted on said motor, and at least one of said stabilizers is of selectively variable eccentricity with respect to said motor.

14. The apparatus of claim 10, further including survey tool means adapted to be run inside said inner string drill pipe means to a location proximate said fluid driven motor means.

15. The apparatus of claim 14, wherein said survey tool means is articulated.

16. An apparatus for drilling and lining a wellbore, comprising:

a tubular outer string including a leading end and having a plurality of centralizer means disposed thereabout at longitudinally spaced intervals, said outer string including at least one section having apertures through the wall thereof;

an inner string disposable within said outer string and including:

drill pipe means, bit drive means disposed on said drill pipe means, and a drill bit for defining a bore of greater diameter than said outer string, driven by said bit drive means and disposable outside said outer string and proximate said leading end; and means for arresting the passage of said inner string beyond said outer string.

17. An apparatus for drilling and lining a wellbore, comprising:

a tubular outer string including a leading end;

an inner string disposable within said outer string and including:

drill pipe means having a longitudinal axis, fluid driven motor means disposed on said drill pipe means and adapted to receive said driving fluid therethrough, a drill bit for defining a bore of greater diameter than said outer string, driven by said fluid driven motor means and disposable outside said outer string proximate said leading end, and a ball joint interposed between said drill pipe means and said fluid driven motor means and adapted to prevent mutual rotation therebetween while permitting variation of an included angle defined between said drill pipe means longitudinal axis and said fluid driven motor means longitudinal axis; and means for arresting the passage of said inner string through said outer string.

18. An apparatus for drilling and lining a wellbore, comprising:

a tubular outer string including a leading end;

an inner string disposable within said outer string and including:

drill pipe means, fluid driven motor means disposed on said drill pipe means and adapted to receive said driving fluid therethrough, and a drill bit for defining a bore of greater diameter than said outer string, driven by said fluid driven motor means and disposable outside said outer string proximate said leading end;

means for arresting the passage of said inner string through said outer string; and survey tool means adapted to be run inside said inner string drill pipe means to a location proximate said fluid driven motor means.

19. The apparatus of claim 18, wherein said survey tool means is articulated.

* * * * *

UNITED STATES PATENT AND TRADEMARK OFFICE

CERTIFICATE OF CORRECTION

PATENT NO. : 5,074,366

DATED : December 24, 1991

INVENTOR(S) : Karlsson, et al.

It is certified that error appears in the above-identified patent and that said Letters Patent is hereby corrected as shown below:

In Column 7, line 56, "$0" should read --80--.
In Column 8, line 60, "caring" should read --coring--.

Signed and Sealed this

Eighth Day of June, 1993

*Attest:*

Michael K. Kirk

MICHAEL K. KIRK

*Attesting Officer*

*Acting Commissioner of Patents and Trademarks*